US011508564B2

(12) United States Patent
Gardner

(10) Patent No.: US 11,508,564 B2
(45) Date of Patent: Nov. 22, 2022

(54) ION PUMPS AND ION PUMP ELEMENTS

(71) Applicant: Hamilton Sundstrand Corporation, Charlotte, NC (US)

(72) Inventor: Ben D. Gardner, Colton, CA (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 904 days.

(21) Appl. No.: 14/548,240

(22) Filed: Nov. 19, 2014

(65) Prior Publication Data

US 2016/0141160 A1 May 19, 2016

(51) Int. Cl.
*H01J 41/12* (2006.01)

(52) U.S. Cl.
CPC ..... *H01J 41/12* (2013.01)

(58) Field of Classification Search
CPC ..... F04B 37/10; F04B 37/14; F04B 37/16; F04B 19/006; H01J 41/12; H01J 41/14; H01J 41/16; H01J 41/18; H01J 41/20
USPC ..... 417/49; 313/7, 562
See application file for complete search history.

(56) References Cited

U.S. PATENT DOCUMENTS 3,350,590 A * 10/1967 Young ..... H01J 41/04 313/348
3,609,062 A * 9/1971 Zucchinelli ..... H01J 7/18 417/48
3,662,522 A * 5/1972 Della Porta ..... H01J 7/18 417/51
3,713,754 A * 1/1973 Laurenson ..... H01J 41/20 417/49
3,796,917 A * 3/1974 Hiller ..... H01J 41/06 313/562
3,994,625 A * 11/1976 Welch ..... H01J 41/20 313/558
7,615,765 B2 * 11/2009 Katagiri ..... H01J 37/18 250/492.1

* cited by examiner

*Primary Examiner* — Dominick L Plakkoottam
*Assistant Examiner* — Charles W Nichols
(74) *Attorney, Agent, or Firm* — Locke Lord LLP; Joshua L. Jones; Scott D. Wofsy

(57) ABSTRACT

An ion pump includes an evacuateable envelope having a chamber. A first and a second cathode are disposed within the chamber and spaced apart from one another. An anode is spaced apart from and between the first and second cathodes. The anode has an anode body with a textured surface that defines capture regions for fixing material sputtered from the first and second cathodes and controlling size of sputter depositions shed from the anode.

10 Claims, 7 Drawing Sheets

ION PUMPS AND ION PUMP ELEMENTS

BACKGROUND OF THE INVENTION

1. Field of the Invention

The present disclosure relates to ion pumps, and more particularly to pump elements for ion pump vacuum systems.

2. Description of Related Art

Ion pumps generally operate by converting gaseous molecules into a solid state for purposes of achieving a relatively high vacuum. Conventional ion pumps typically include an enclosure housing an anode, a cathode, and a magnet disposed in relation to the anode for developing a magnetic field within the anode. Upon application of a voltage, the anode and cathode develop opposite charges such that an electric field develops between the anode and cathode. Electrons form within the anode and ionize gas molecules that enter the anode. Once ionized, the electric field accelerates the ionized gas molecules into the cathode such that they impact with velocity sufficient to either lodge within the cathode or deposit within the enclosure as sputtered material. In some ion pumps, ion impacts eject material from the cathode, which deposits within the enclosure as sputtered material. Since the anode is typically adjacent to the cathode, sputtered material generally forms on anode portions proximate to the cathode. The sputtered material can shed from the anode surface as a mobilized solid-state material, potentially lodging between the anode and cathode, temporarily shorting the anode and cathode and reducing the efficacy of the ion pump.

Such conventional methods and systems have generally been considered satisfactory for their intended purpose. However, there is still a need in the art for improved ion pumps and ion pump elements that can reduce the consequences of sputtered material shedding from the anode. The present disclosure provides a solution for this need.

SUMMARY OF THE INVENTION

An ion pump includes an evacuateable envelope having a chamber. A first cathode and a second cathode are disposed within the chamber and spaced apart from one another. An anode is spaced apart from and between the first cathode and the second cathode. The anode includes an anode body having a contoured-textured surface with a contoured surface adjacent to a textured surface. The textured surface defines capture regions for fixing material sputtered from at least one of the cathodes and controlling size depositions shed from the anode.

In certain embodiments, the textured surface includes a roughed surface having at least one franging structure. The textured surface can include a plurality of franging structures. The textured surface can include a mesh structure. The mesh structure can include a plurality of wires angled with respect to one another. At least one of the mesh structure wires can be orthogonal or parallel with respect to the first cathode. At least one of the wires can be angled with respect to the first cathode, such as at a 90-degree, 180-degree, or an oblique angle. It is contemplated that the textured surface can be defined by one or more ribs integral with the contoured surface. The ribs can be angled with respect to the first cathode, such as at a 90-degree, 180-degree, or an oblique angle.

In accordance with certain embodiments, the textured surface is disposed on an interior surface of the anode body. The textured surface can also be defined on an exterior surface of the anode body. The textured surface can be defined on both interior and exterior surfaces of the anode body. It is contemplated that the contoured surface can overlay or underlay the textured surface at an end of the anode body adjacent to either cathode.

It is also contemplated that in accordance with certain embodiments the anode body can have a cylindrical shape with a first end and an opposite second end. The first end can face the first cathode. The second end can face the second cathode. The textured surface can include a first textured surface and a second textured surface, the first textured surface being disposed on the first end of the anode body and the second textured surface being disposed on the second end of the anode body. The contoured surface can separate the first textured surface from the second textured surface. It is further contemplated that the cylindrical textured-contoured surface can be a first cylindrical surface, and the anode body can define at least a second cylindrical textured-contoured surface. The second cylindrical textured-contoured surface can be arranged in parallel with the first cylindrical textured-contoured surface.

An ion pump includes an evacuateable envelope having a chamber, first and second cathodes spaced apart within the chamber, and an anode spaced between the first and second cathodes. The anode includes a mesh body having regular or irregular repetitive surface structures defining capture regions for fixing material sputtered from the first and second cathodes and controlling size of sputter depositions shed from the anode.

In embodiments, the repetitive surface structure can be defined by a porous body. The repetitive surface structure can also be defined by an electroformed wire-like body. The repetitive surface structure can further be formed from discrete wires angled with respect to one another and defining the capture regions therebetween. The mesh body can extend between a first end and an opposed second end, and the first end can face the first cathode and the second end can face the second cathode. The mesh body can have a cylindrical shape and define an axis extending through the center of the mesh body. The axis can be substantially orthogonal to surfaces of both the first cathode and second cathode.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
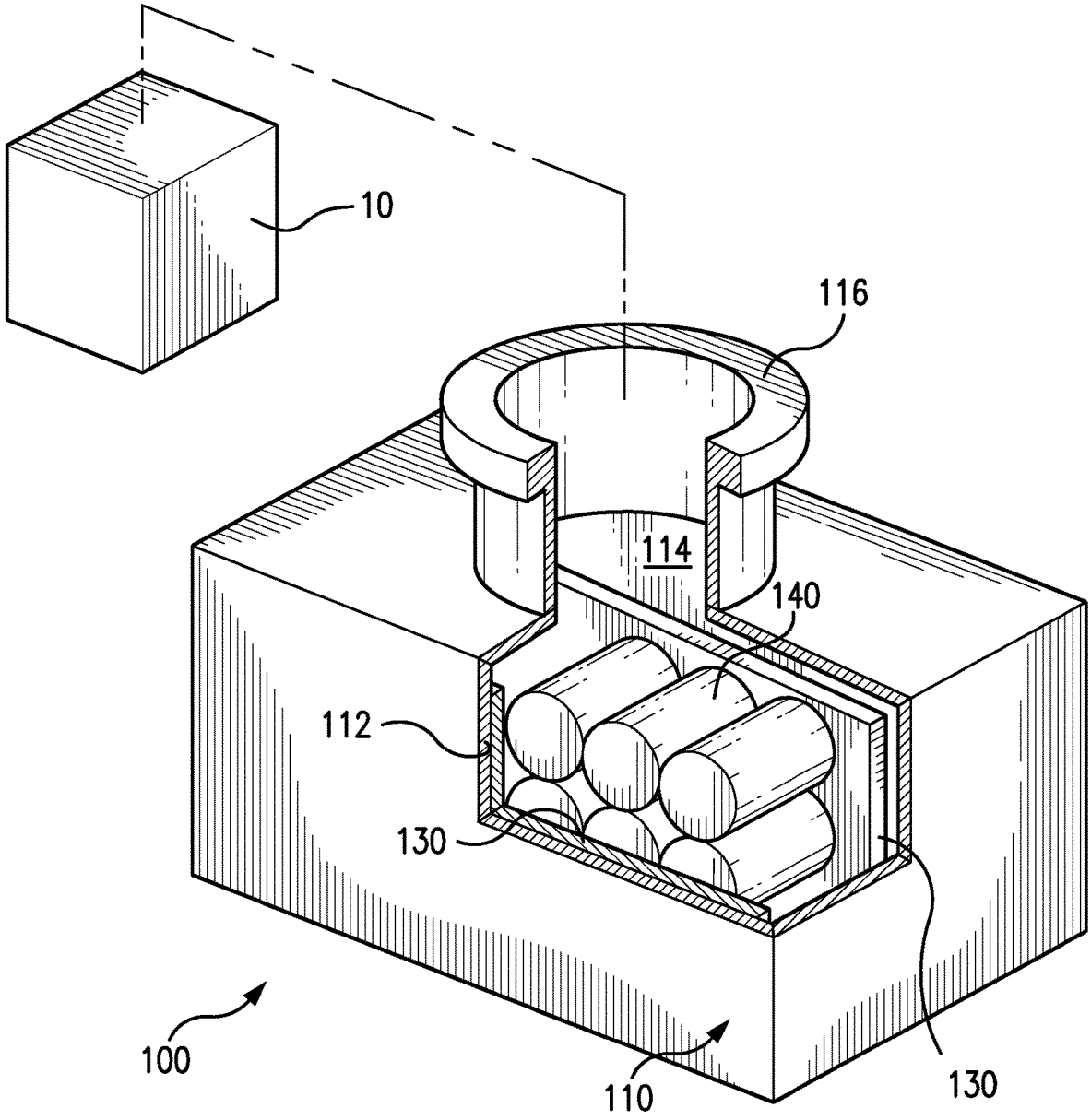
FIG. 1 is a partial sectional perspective view of an exemplary embodiment of an ion pump constructed in accordance with the present disclosure, showing the ion pump interior.

Reference will now be made to the drawings wherein like reference numerals identify similar structural features or aspects of the subject disclosure. For purposes of explanation and illustration, and not limitation, a partial view of an exemplary embodiment of an ion pump in accordance with the disclosure is shown in FIG. 1 and is designated generally by reference character 100. Other embodiments of ion pumps in accordance with the disclosure, or aspects thereof, are provided in FIGS. 2-9, as will be described. The systems and methods described herein can be used with systems requiring evacuated environments, such as mass spectrometers for low-gravity or terrestrial environments.

Ion pump 100 includes a housing 110, a magnet structure 120 (shown in FIG. 2), a cathode structure 130, and an anode structure 140. Housing 110 forms an evacuateable envelope 112 bounding an internal chamber 114 and has a fitting 116. Fitting 116 is configured and adapted for coupling chamber 114 with a device requiring evacuation, such as a mass spectrometer 10. Housing 110 and fitting 116 are formed from a material such as aluminum or stainless steel, and are configured and adapted for sustaining a pressure differential of at least one atmosphere between interior 114 and the environment external to housing 110.

Figure 2:
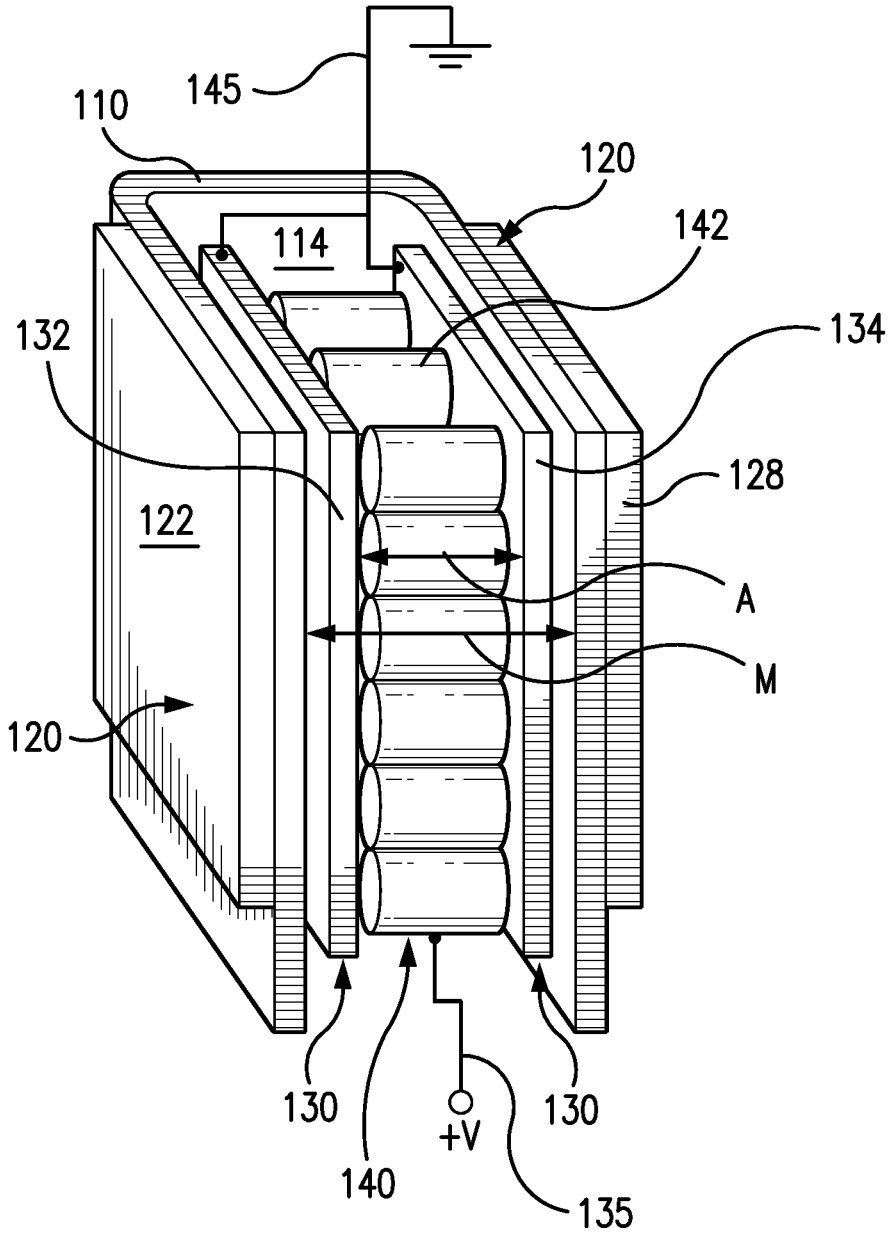
FIG. 2 is a partial sectional perspective view of the ion pump of FIG. 1, showing the magnet structure, cathode structure, and anode structure of the ion pump.

With reference to FIG. 2, magnet structure 120, cathode structure 130, and anode structure 140 are shown. Magnet structure 120 includes a magnetic body constructed from a magnetic material, such as ferrite or any other suitable material, and having a first pole end 122 and a second pole end 128. First pole end 122 and second pole end are 128 are both fixed to the exterior of housing 110 such that housing 110, cathode structure 130, and anode structure 140 are disposed between first pole end 122 and second pole end 128. First pole end 122 and second pole end 128 are configured and adapted for generating a persistent magnetic field M that extends through interior 114 between first pole end 122 and second pole end 128. Magnetic field M also extends though cathode structure 130 and anode structure 140 and is configured and adapted for driving electrons within anode structure 140 to achieve a circular orbit within anode structure 140. As will be appreciated by those skilled in the art, this increases the probability of the electrons interacting with and ionizing gas molecules within interior 114.

Cathode structure 130 includes a first cathode 132 and a second cathode 134. As illustrated, first cathode 132 and second cathode 134 are joined to one another in a yoke-like structure. In embodiments, first cathode 132 and second cathode 134 are discrete structures physically separated from one another by anode structure 140. First cathode 132 and second cathode 134 are both disposed within interior 114 on opposite sides of anode structure 140 such that anode structure 140 is between first cathode 132 and second cathode 134. Cathode structure 130 can include titanium, tantalum, zirconium, or any other suitable material. A cathode lead 145 is connected to cathode structure 130 (or, in embodiments, independently both first cathode 132 and second cathode 134) and is configured and adapted for electrically connecting cathode structure 130 to a ground or reference voltage.

Anode structure 140 is disposed within chamber 114 between first cathode 132 and second cathode 134. Anode structure 140 includes an anode body 142 that defines a plurality of cylindrical structures 144 (shown in FIG. 3) with interior substantially cylindrically-shaped surfaces which define an acceleration axis A. An anode lead 135 is connected to anode body 142 that is configured and adapted for connecting anode body 142 to a voltage source.

Figure 3:
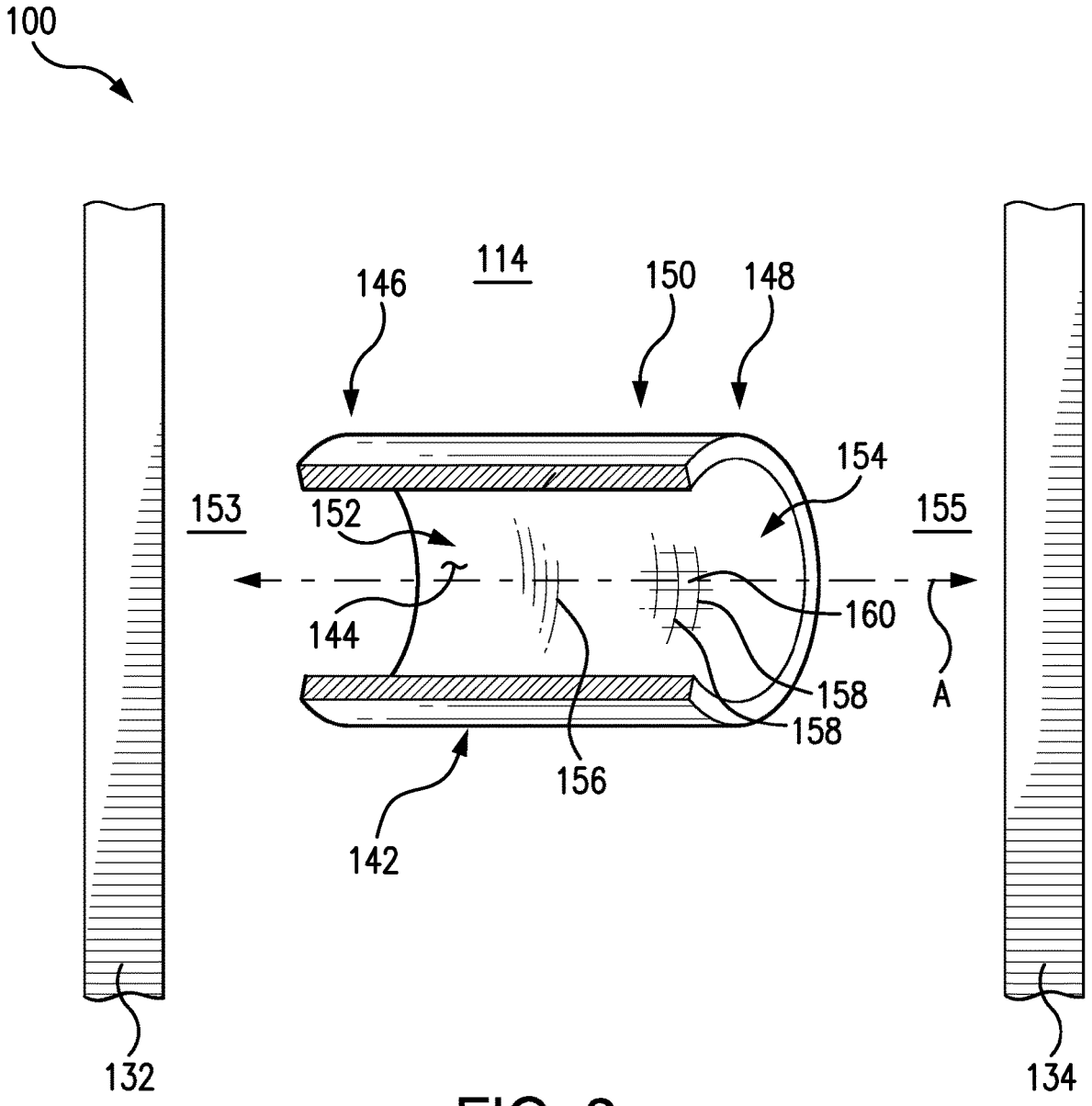
FIG. 3 is a perspective view of an anode body for the anode structure of FIG. 1, showing a contoured-textured surface of the anode body.

With reference to FIG. 3, anode body 142 is shown. Anode body 142 has first end 146, a second end 148, and a midsection 150 spanning between first end 146 to second end 148 and defining a hollow cylindrical structure 144. Cylindrical structure 144 is an inward facing contoured-textured surface having a contoured portion 152 and a textured portion 154. Contoured portion 152 is substantially smooth and may include microstructures 156 that are not visually discernable. Textured portion 154 is adjacent to contoured portion 152 and includes a plurality of franging structures 158. The plurality of franging structures 158 are relatively large structures in comparison to microstructures 156. Adjacent franging structures 158 define between one another capture regions 160 configured and adapted for fixing material deposited thereon, such as ejectant dislodged from cathode structure 130, e.g. first cathode 132 and/or second cathode 134, resultant from ionized gas impacts. Respective franging structures 158 define structures such as relatively sharp corners defined by the arcuate segments that cause formation of regions of structural weakness to develop in the overlying sputter deposition. This limits the size of sputter deposits shed from cylindrical surface 144. This can also enable the overlying sputter deposition to remain on the anode, potentially increasing the service life of the anode assembly, ion pump, and/or system incorporating the ion pump.

Ion pump 100 removes gas molecules from interior 114 by ionizing the gas molecules, accelerating the ionized gas toward cathode structure 130, and impacting the ionized gas with cathode structure 130. Upon impact the ionized gas either lodge within cathode structure 130, or chemically combine with cathode structure 130 (, the gas molecules thereby being removed from interior 114 and correspondingly reducing pressure within chamber 114. The impact can cause material to be ejected from cathode structure 130 and deposit on anode body 142, anode body 142 thereby progressively developing a sputter deposition that thickens over time. Such depositions typically thicken over time, fracture, and shed deposition fragments from the anode body.

Under certain conditions, deposition fragments shed from the anode body can bridge the gaps defined between ends of the anode body and cathode structure. When fragments lodge in the gap the fragments can electrically short the anode body and cathode structure, reducing the potential difference between the structures, and reducing the capacity of the ion pump to ionize gas molecules disposed within the pump. This can reduce the efficiency of the ion pump and/or impair the functionality of the device serviced by the ion pump.

Franging structures 158 reduce the likelihood of fragments shorting the anode and cathode potential difference. By spacing a given franging feature apart from an adjacent franging feature the width of the capture region between the franging structures can be defined such that fragment(s) shed from the capture region are smaller than a predetermined size. The predetermined size can be less than the width of the gap between the anode and cathode. This reduces the likelihood that fragments shed from the capture region will lodge between the gap between the anode and cathode, improving the reliability of the ion pump. This can be particularly advantageous in low gravity environments where deposition fragments may be more mobile within the chamber, and therefore more be likely to lodge between the anode and cathode structures than in environments where gravity tends to fix deposition fragments to the floor of the chamber. Franging structures 158 can also reduce the likelihood of the anode body shedding sputtered material from the surface of the anode body.

Figure 4:
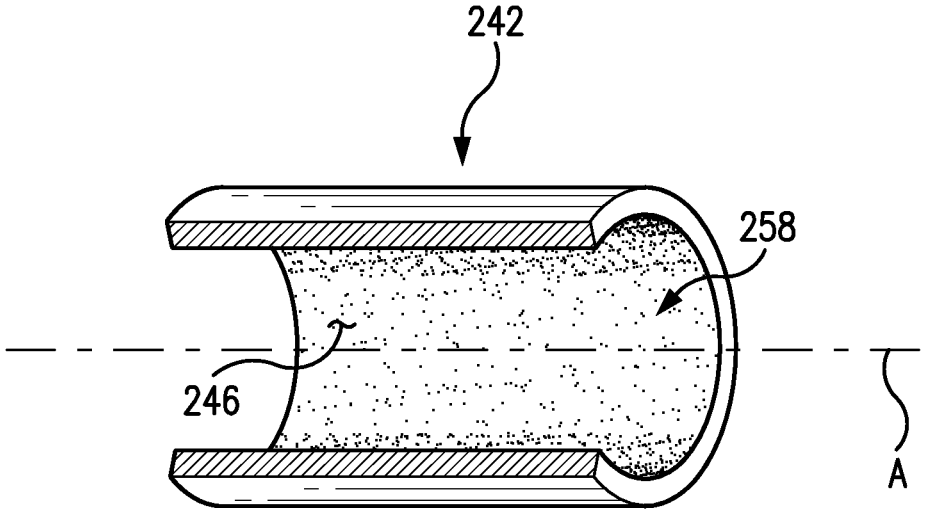
FIG. 4 is a perspective view of an embodiment of an anode body having a contoured-textured surface, showing a roughened surface.

With reference to FIG. 4, an anode body 242 for an ion pump is shown. Anode body 242 is similar to anode body 142 (shown in FIG. 3) and additionally includes a roughened surface 246. Roughed surface 246 has disposed along its axial length a plurality of discrete franging structures 258. Franging structures 258 can be distributed uniformly or unevenly as suitable for an intended application, a greater number of discrete franging structures (or vice versa) being disposed on ends of anode body 242 than are disposed on the midsection of anode body 242. Roughened surface 246 can be created by chemically treating cylindrical surface 246, such as by using an etching process. This can simplify manufacture of anode body 242.

Figure 5:
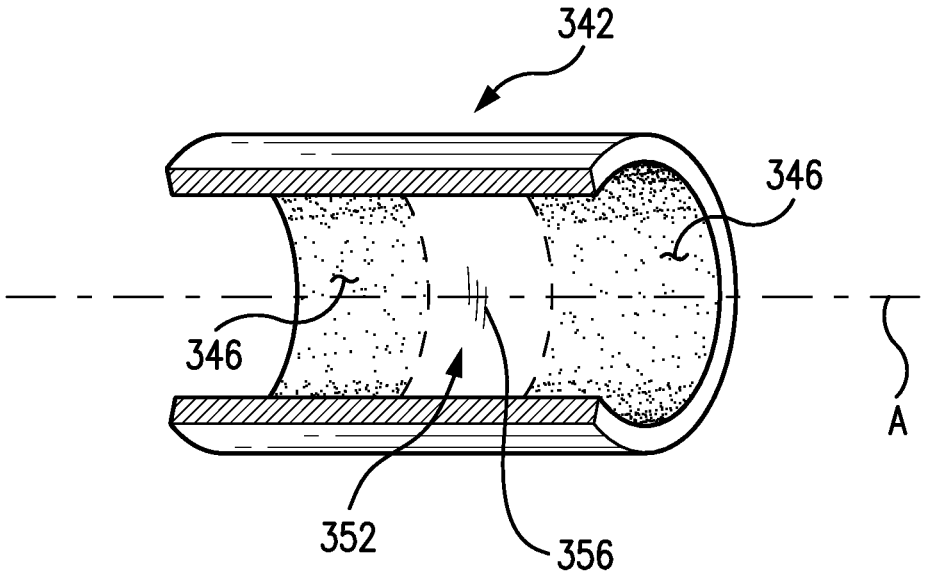
FIG. 5 is a perspective view of an embodiment of an anode body having a contoured-textured surface, showing roughened and contoured surface portions.

With reference to FIG. 5, an anode body 342 is shown. Anode body 342 is similar to anode body 242 (shown in FIG. 4) and additionally includes roughened surface portions 346 disposed on opposite ends of anode body 342 and separated by a contoured surface portion 352. Contoured surface portion 352 is smooth (e.g. includes microstructures 356), and in embodiments is substantially featureless. In ion pump arrangements where ends of the anode body are relatively close to the cathode structure, and therefore likely to develop sputter depositions more rapidly than the central contoured portion, limiting the roughened surface portions to the ends of the anode body can provide fragment size control while reducing the impact that the roughened surface portion might have on performance of the anode. It can also improve the mechanical robustness of anode body as little (if any) material is removed from contoured surface portion.

Figure 6:
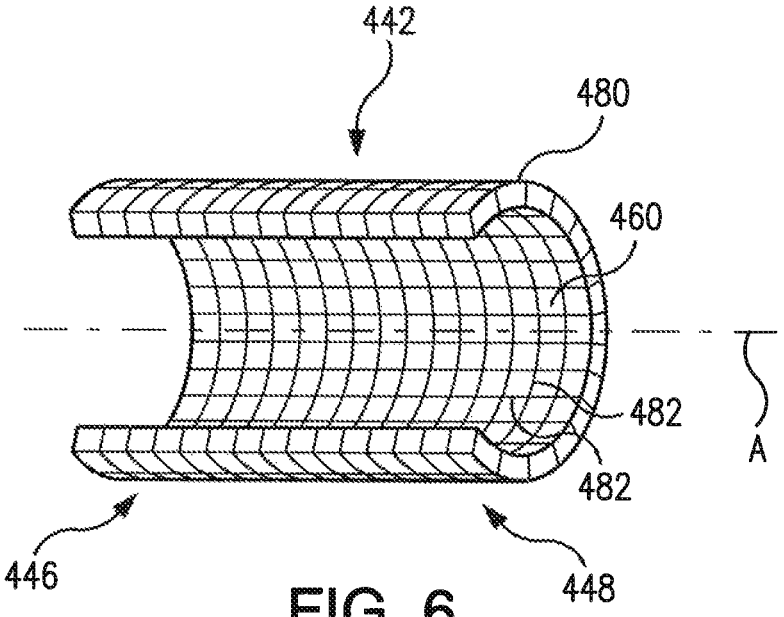
FIG. 6 is a perspective view of an embodiment of an anode body having a mesh body, showing angled wires forming the mesh body.

With reference to FIG. 6, an anode body 442 is shown. Anode body 442 includes a mesh body 480. Mesh body 480 extends between first end 446 and second end 448 and is formed from a plurality of wires, a woven surface (or fabric), an electroformed mesh, or any other suitable mesh-like structure. Mesh body 480 includes a plurality of wires 482 (or wire-like structures) that are angled with respect to one another and which define therebetween a plurality of capture regions 460. Capture regions 460 are disposed both interior and exterior surfaces of anode body 442, and in certain embodiments, extend through mesh body 480 to apertures extending from an interior to an exterior of mesh body 480. As illustrated, wires 482 are substantially orthogonal to one another.

In embodiments, at least one of wires 482 is orthogonal with respect to cathode structure 130 (shown in FIG. 3). In certain embodiments, at least one of wires 482 is parallel to cathode structure 130 (shown in FIG. 3). It is also contemplated that at least one of wires 482 can be oblique or randomly oriented relative to the other of wires 482. Either or both of wires 482 can also be angled with respect to cathode structure 130 (shown in FIG. 3).

Figure 7:
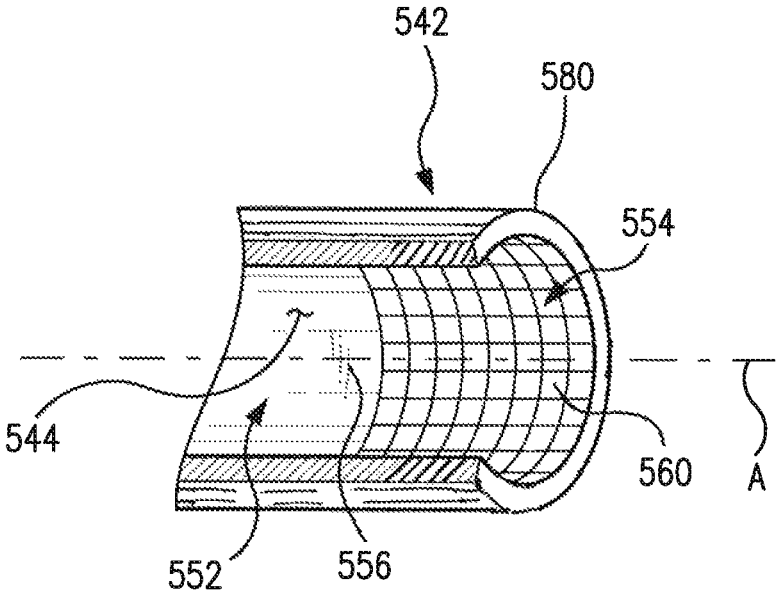
FIG. 7 is a perspective view of an embodiment of an anode body having a partial mesh body, showing the mesh body radially overlapping a portion of the anode body.

With reference to FIG. 7, an anode body 542 is shown. Anode body 542 is similar to anode body 442 (shown in FIG. 6) and additionally includes a mesh body 580 disposed on an end and radially inward relative to a cylindrical surface 544. Cylindrical surface 544 includes a contoured surface portion 552 that is smooth, e.g. including one or more microstructures 556 or is featureless, and mesh body 580 forms a textured surface portion 554. Mesh body 580 defines a textured surface portion 554 including a plurality of capture regions 560. Capture regions 560 extend from an interior of anode body 542 to an underlying surface of anode body 442. This arrangement provides the capacity to capture ejected cathode material having a relatively low incidence angle, e.g. less than 90-degrees relative to axis A, in relation to acceleration axis A while providing a mechanically robust anode body structure.

Figure 8:
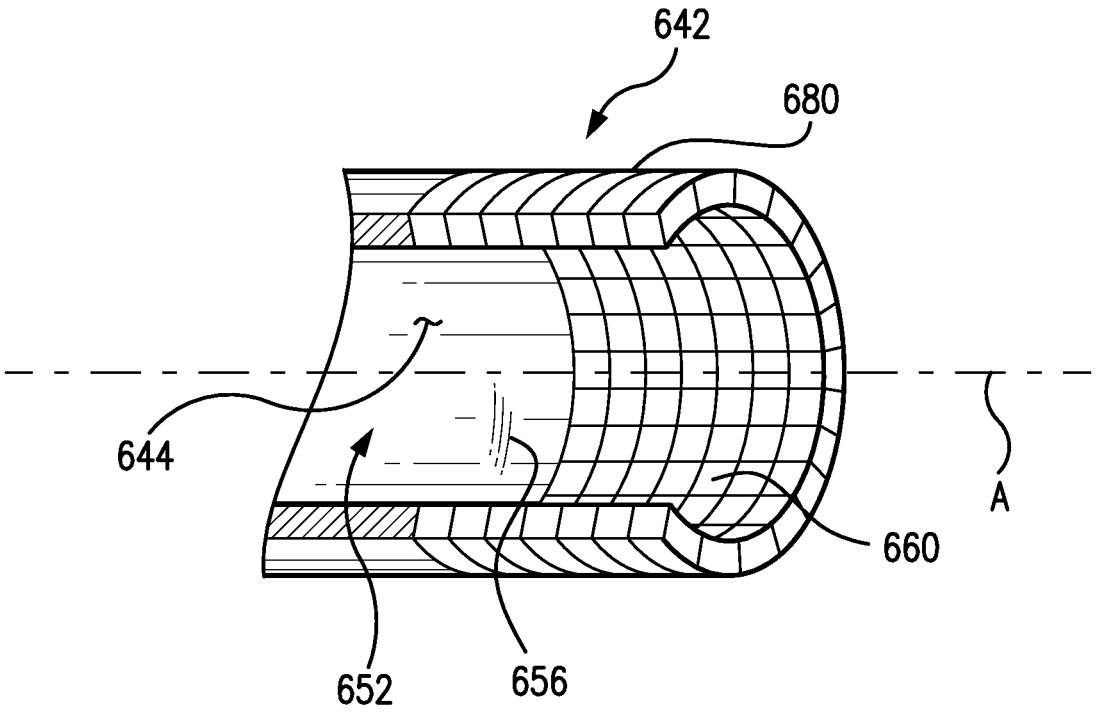
FIG. 8 is a perspective view of an embodiment of an anode body having a partial mesh body, showing the mesh body extending axially from the anode body.

With reference to FIG. 8, an anode body 642 is shown. Anode body 642 is similar to anode body 442 (shown in FIG. 6) and additionally includes a partial mesh body 680. Partial mesh body 680 extends axially from the cylindrical anode body portion. Partial mesh body 680 can provide anode body 642 with the capacity to capture sputtered material having incidence angles approaching 0-degrees relative to axis A as capture regions 660 are accessible from both an interior and an exterior of anode body 642.

Figure 9:
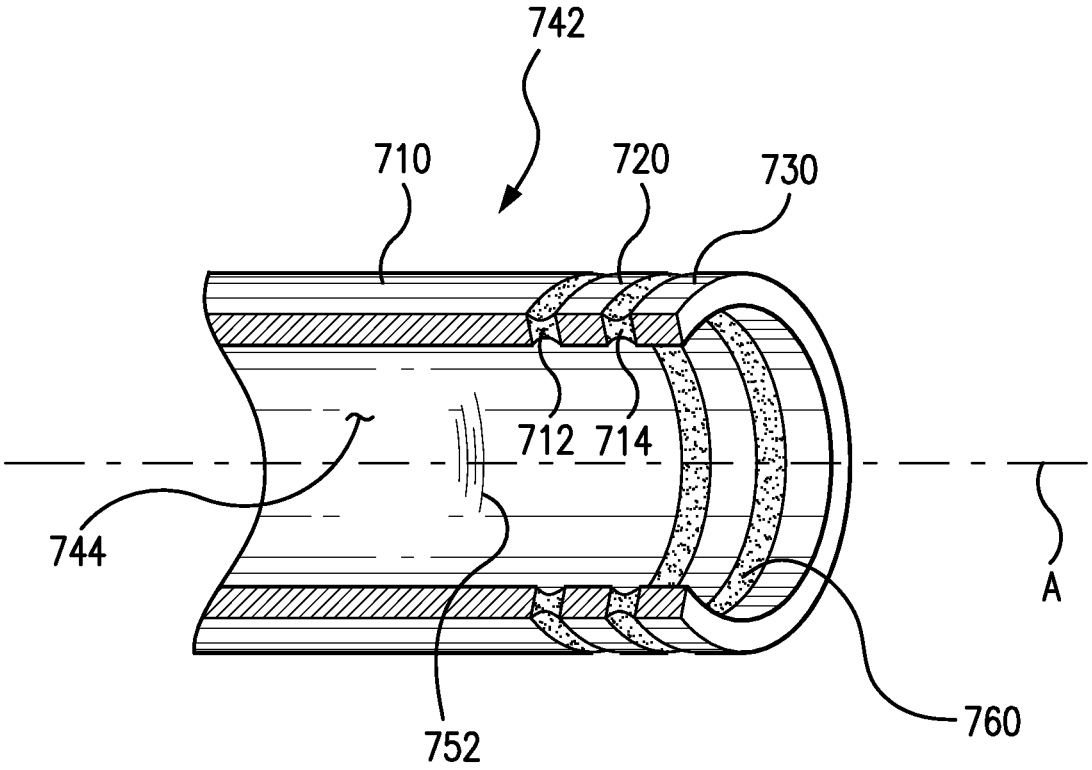
FIG. 9 is a perspective view of an embodiment of an anode body having an axially segmented body.

With reference to FIG. 9, an anode body 742 is shown. Anode body 742 is similar to anode body 142 and additionally includes a plurality of segments fixed to an end of anode body 742. In this respect anode body 742 includes a mid-segment 710, first body segment 720, and a second body segment 730 wherein mid-segment 710 includes a contoured surface 744. Contoured surface 744 can be smooth, i.e. include a plurality of microstructures 752, or can be substantially featureless. First body segment 720 is coupled to mid-segment 710 by a first intermediate coupling 712. Second body segment 730 is coupled to first body segment 720 by a second intermediate coupling 714. Anode body 742 can have a single body segment, two body segments (as illustrated), or any number of body segments as suitable for an intended application.

Either or both of first intermediate coupling 712 and second have a thickness that is different from a thickness of first body segment 720 and second body segment 730. In the illustrated exemplary embodiment both first intermediate coupling 712 and second intermediate coupling 714 have thicknesses that are smaller than thicknesses of mid-segment 710 and first body segment 720 on both interior and exterior surfaces of anode body 742. The reduced thickness areas of first intermediate coupling 712 and second intermediate coupling 714 defines a textured surface with a plurality of sputtered material capture regions 760 disposed on interior and exterior surfaces of anode body 752 for capturing sputtered material. Axial edges of first body segment 720 and second body segment 730 adjacent the intermediate couplings define franging structures for controlling the size of sputtered material shed from anode body 752.

The methods and systems of the present disclosure, as described above and shown in the drawings, provide for ion pumps with superior properties including improved sputter retention and control size of sputtered material fragments shed from ion pump anode structures. While the apparatus and methods of the subject disclosure have been shown and described with reference to preferred embodiments, those skilled in the art will readily appreciate that changes and/or modifications may be made thereto without departing from the spirit and scope of the subject disclosure.

What is claimed is:

1. An ion pump, comprising:

an evacuable envelope having a chamber;

first and second cathodes spaced apart within the chamber; and an anode spaced between the first and second cathodes, including:

an anode body having an anode surface, wherein the anode surface includes a substantially cylindrically-shaped interior surface, wherein the interior surface includes an inward facing -contoured surface portion and a textured surface portion adjacent the contoured surface portion, wherein the contoured surface portion is substantially smooth and featureless and the textured surface defines a plurality of sputtered material capture regions bounding the contoured surface portion, wherein a first uninterrupted sputtered material capture region contacts a first end of the anode body and an uninterrupted contoured surface portion is in contact with the first uninterrupted sputtered material capture region and extends toward a second end of the anode body.

2. An ion pump as recited in claim 1, wherein textured surface portion includes a roughed surface having a plurality of franging structures.

3. An ion pump as recited in claim 1, wherein the textured surface portion includes a plurality of wires angled with respect to one another.

4. An ion pump as recited in claim 3, wherein the at least one of the plurality of wires is orthogonal with respect to the first cathode.

5. An ion pump as recited in claim 3, wherein at least one of the plurality of wires is parallel with respect to the first cathode.

6. An ion pump as recited in claim 3, wherein at least one of the plurality of wires is oblique with respect to the first cathode or another of the plurality of wires.

7. An ion pump as recited in claim 1, wherein the anode body cylindrical contoured-textured surface is a first contoured-textured surface, and further including a second contoured-textured surface parallel to the first contoured-textured surface.

8. An ion pump as recited in claim 1, wherein the textured surface portion defines a plurality of apertures extending between an interior of the anode body to an exterior of the anode body defining the sputtered material capture regions.

9. A method of making an ion pump, comprising:

at an evacuable envelope having a chamber, spacing apart within the chamber first and second cathodes;

defining a substantially cylindrically-shaped interior surface on an anode, wherein the interior surface includes an inward facing contoured surface portion and a textured surface portion adjacent the contoured surface portion, wherein the contoured surface portion is substantially smooth and featureless and the textured surface portion defines a plurality of sputtered material capture regions bounding the contoured surface portion, wherein the textured surface portion is defined by angling a plurality of wires relative to one another, wherein a first uninterrupted sputtered material capture region contacts a first end of the anode and an uninterrupted contoured surface portion is in contact with the first uninterrupted sputtered material capture region and extends toward a second end of the anode, wherein the wires are formed using an electroforming process.

10. An ion pump, comprising:

an evacuable envelope having a chamber;

first and second cathodes spaced apart within the chamber; and an anode spaced between the first and second cathodes, wherein the anode includes a mesh body having a plurality of wires angled with respect to one another, wherein the plurality of wires define therebetween a plurality of sputtered material capture regions disposed on both an interior surface and an exterior surface of the anode, wherein at least one of the plurality of wires is oblique with respect to the first cathode or another of the plurality of wires;

wherein the anode includes an anode surface having a substantially cylindrically-shaped interior surface, wherein the interior surface includes an inward facing contoured surface portion and a textured surface portion adjacent the contoured surface portion, wherein the contoured surface portion is substantially smooth and featureless and the textured surface defines a plurality of sputtered material capture regions bounding the contoured surface portion, wherein the textured surface defines a plurality of sputtered material capture regions bounding the contoured surface portion, wherein a first uninterrupted sputtered material capture region contacts a first end of the anode body and an uninterrupted contoured surface portion is in contact with the first uninterrupted sputtered material capture region and extends toward a second end of the anode body.

* * * * *